US007546823B2

(12) United States Patent
Buelna

(10) Patent No.: US 7,546,823 B2
(45) Date of Patent: Jun. 16, 2009

(54) VARIABLE OVERHEAD VALVE CONTROL FOR ENGINES

(76) Inventor: Terry Buelna, 17 Coach La., Simpsonville, SC (US) 29681

( * ) Notice: Subject to any disclaimer, the term of this patent is extended or adjusted under 35 U.S.C. 154(b) by 330 days.

(21) Appl. No.: 11/418,360

(22) Filed: May 4, 2006

(65) Prior Publication Data

US 2006/0260575 A1 Nov. 23, 2006

Related U.S. Application Data

(60) Provisional application No. 60/681,401, filed on May 17, 2005.

(51) Int. Cl.
*F01L 1/34* (2006.01)

(52) U.S. Cl. ..... 123/90.16; 123/90.39; 123/90.44; 123/90.61; 74/559; 74/569; 29/888.2

(58) Field of Classification Search ..... 123/90.16, 123/90.2, 90.44, 90.27, 90.31, 90.6, 90.39, 123/90.61, 90.62, 90.63, 90.64; 74/559, 74/567, 569; 29/888.2
See application file for complete search history.

(56) References Cited

U.S. PATENT DOCUMENTS 4,572,118 A 2/1986 Baguena
4,723,516 A * 2/1988 Slagley et al. ..... 123/90.16
4,898,130 A * 2/1990 Parsons ..... 123/90.16
5,113,813 A 5/1992 Rosa
5,937,809 A 8/1999 Pierik et al.
7,040,267 B2 * 5/2006 Duesmann ..... 123/90.16
7,124,721 B2 * 10/2006 Lechner ..... 123/90.16
2004/0089254 A1 5/2004 Pomerlau
2004/0103865 A1 6/2004 Duesmann

OTHER PUBLICATIONS

Written Opinion of International Searching Authority, Jul. 3, 2007, (6 pages).
International Search Report, Sep. 9, 2007, (3 pages).

* cited by examiner

*Primary Examiner*—Ching Chang
(74) *Attorney, Agent, or Firm*—Stetina Brunda Garred & Brucker

(57) ABSTRACT

A valve control mechanism is provided for an overhead valve, internal combustion engine having a camshaft moving a pushrod to move a rocker arm that in turn moves the valve. Three aligned rollers are fastened to the end of the pushrod adjacent the rocker arm. The outer two rollers roll along parallel profiled surfaces that control at least the valve lift and ramp. The middle roller rolls along an engaging surface on the rocker to move the rocker arm in a motion determined by the configuration and location of the profiled surfaces and the engaging first and second rollers. The outer rollers rotate in a direction opposite the middle roller.

20 Claims, 11 Drawing Sheets

VARIABLE OVERHEAD VALVE CONTROL FOR ENGINES

RELATED APPLICATION

This application claims the benefit under 35 U.S.C. §119 (e), of application Ser. No. 60/681,401, filed May 17, 2005, the entire contents of which are incorporated herein by reference.

BACKGROUND

This document describes a mechanism for a variable valve control of overhead-valve (OHV) internal combustion piston engines. An OHV engine is typically defined as an engine that has poppet type intake and/or exhaust valves located in the engine cylinder head, one or more camshafts located in the cylinder block, and with the valves being actuated via lifters, pushrods and rocker arms. OHV engines may be of various cylinder configurations such as vee, in-line or opposed. The OHV engine architecture is widely used because it is economical to manufacture, provides a compact physical package size and is reliable in service Variable valve control is a very desirable feature in an engine because it can reduce exhaust emissions, reduce fuel consumption and improve power output characteristics. There are several known methods of variable valve control, such as electromagnetic (U.S. Pat. No. 4,777,915) or hydraulic (U.S. Pat. No. 6,739,293). However, these systems typically require complex and expensive control systems and tend to be unreliable in service. There are also mechanical systems (U.S. Pat. No. 6,792,903) but these typically require an overhead cam type engine architecture, which can be expensive to manufacture. Therefore, what is needed is a mechanical variable valve control device that can be incorporated into an OHV type engine.

SUMMARY

A valve control mechanism is provided for an overhead valve, internal combustion engine having a camshaft moving a pushrod to move a rocker arm that in turn moves the valve. The mechanism preferably includes a first and second roller each rollably connected to the end of the pushrod that is opposite the camshaft and adjacent the rocker. A roller guide is provided and has a first profiled surface, with the first roller and roller guide positioned so the first roller rolls along the first profiled surface. The first profiled surface is configured to achieve a desired valve movement, such as valve closed, ramp and lift. An engaging surface is provided on the rocker arm with the rocker arm and second roller positioned so the second roller rolls along the engaging surface of the rocker arm to rotate the rocker arm as the first roller rolls along the first profiled surface. Ideally the first roller rolls in one direction along the profiles surface while the second roller rolls in an opposite direction against the engaging surface to move the rocker arm according to the first profiled surface.

In further variations, the roller guide is positionable along a first axis which is preferably, but optionally parallel to the engaging surface. Further, there is preferably, but optionally a third roller rollably connected to the end of the pushrod opposite the camshaft, with the first and third rollers being on opposing sides of the second roller, and with the roller guide having a second profiled surface spaced apart from the first profiled surface but configured the same as the first profiled surface and located to engage the second roller.

The third roller is preferably rollably connected to the end of the pushrod opposite the camshaft, with the first and third rollers being on opposing sides of the second roller, ideally with the first and third rollers being of smaller diameter than the second roller. Thus, ideally, the first and third rollers roll in one direction against the profiled surfaces while the second roller rolls in an opposing direction against the engaging surface.

The engaging surface on the rocker arm is preferably straight and parallel to a portion of the first profiled surface, and ideally that straight portion controls the valve closed position. But the engaging portion could be inclined, or profiled to further vary the valve operation in a way that differs from having a straight engaging surface parallel to a portion of the profiled surface.

The roller guide is preferably positionable along a first axis to vary the valve operation, and is positionable by a rotating cam which moves the roller guide along that first axis, with a spring resiliently urging the roller guide against that rotating cam. Control of the roller guide could also be provided by incremental rotation of a setting shaft by, for example, an electric motor or a hydraulic actuator either directly, or through various intermediate drive systems such as gears, belts or chains.

Preferably, the profiled surface has a first portion parallel to the engaging surface to alter the valve closed duration, and also has a second middle portion configured to alter valve ramp, with a third portion configured to alter valve lift, as the first roller moves along these three portions of the first profiled surface.

The valve control mechanism also includes a roller guide having at least one, and preferably two similarly profiled surfaces configured to control the valve closed, ramp and valve lift. The profiled surfaces are spaced apart with a slot between them. Three rollers are rollably connected to the end of the pushrod that is opposite the camshaft, with two of the rollers each abutting a different one of the profiled surfaces and the third roller fitting in the slot. A rocker arm surface is formed on one arm of the rocker arm so the rocker arm surface is located opposite the profiled surfaces with the third roller rolling on the rocker arm surface in a direction opposite the other two rollers. Thus, movement of the two rollers along the profiled surface moves the third roller and rocker arm in a corresponding motion.

Preferably, but optionally, the roller guide moves along a first axis generally parallel to a portion of the profiled surface. More preferably, a cammed surface abuts the roller guide to move the roller guide along the first axis in order to alter at least one of the magnitude or duration of the valve lift, ramp or valve closed position and/or duration.

As to the valve lifter, the engaging surface is again preferably a straight surface, but could vary and could include a profiled surface that is not straight. As before, the three rollers preferably, but optionally rotate about parallel axes or rotate about a common axis. Ideally, the third roller that abuts the engaging surface is larger in diameter than the other two rollers.

The control mechanism can also be considered as including a pushrod having a first and second roller rotatably mounted at one end of the pushrod, where the first roller rolls against a profiled surface in a first direction and the second roller rolls against an engaging surface on the rocker arm in an opposing direction to move the rocker arm in a motion defined by the shape of the profiled surface. The profiled surface is preferably on a roller guide that in turn is movable along a first axis located to shift the profiled surface and vary the magnitude of the valve lift, or the valve ramp, or the timing or duration of the valve closed position. Preferably, the roller guide is resiliently urged against a setting camshaft, the rotation of which moves the roller guide along the first axis.

In this embodiment the engaging surface is also preferably a straight surface, and more preferably is generally parallel to a portion of the profiled surface when the valve is closed, and is ideally parallel to the portion of the profiled surface that affects the valve closed duration and/or timing.

In any of the above valve control mechanisms, there is preferably, but optionally a swivel mount on the pushrod and the swivel mount is configured to permit the one end of the pushrod to rotate at least a few degrees. That rotation helps accommodate lateral movement of the rollers which rotate against two different surfaces, surfaces which preferably face or oppose each other.

Moreover, a lifter spring is preferably used to resiliently urge a lifter against the camshaft, with the lifter spring engaging a lifter perch. Preferably, but optionally, the lifter perch abuts a stop on the engine where the stop is located to limit motion of the perch and spring toward the camshaft. Limiting the spring movement limits the force with which the spring urges the lifter against the camshaft, and that can be sued to reduce wear on the non-lifting portions of the camshaft.

There is also provided a method for controlling the operation of a valve in an overhead valve, internal combustion engine having a camshaft moving a pushrod to move a rocker arm that in turn moves the valve. The method includes rolling a first roller connected to the pushrod along and in engagement with a first profiled surface that is configured to control at least the lift and ramp of the valve. The method also includes moving a second roller connected to the pushrod along but not in engagement with the first profiled surface. Further, the method includes rolling the second roller along an engaging surface on the rocker arm and in a direction opposite the first roller. Finally, the method includes pivoting the rocker arm in a motion that results from movement of the first roller along the first profile.

The method also preferably, but optionally has the two rolling steps use rollers that have different diameters. Preferably, the method also includes rolling a third roller connected to the pushrod along and in engagement with a second profiled surface having the same profile as the first profiled surface, and ideally the first and third rollers are on opposite sides of the second roller. The method also optionally includes aligning the rotational axes of these various rollers.

Further, the method also preferably, but optionally includes moving the first profiled surface along an axis generally parallel with a portion of the profiled surface, and doing so to vary at least one of the valve ramp, valve lift or valve closed duration and/or timing. Moreover, the method preferably includes repeatedly cycling the first profiled surface along that axis, and more preferably that axis is generally parallel with a portion of the profiled surface, and ideally that axis is parallel to a portion of the profiled surface that affects the timing and/or duration of the valve closed position.

There is also provided a mechanism for reducing wear on a camshaft of an overhead valve, internal combustion engine where the camshaft moves a pushrod to move a rocker arm that in turn moves the valve. The pushrod has one end engaging a lifter which is resiliently urged against the camshaft by a lifter spring which engages a lifter perch. A stop is formed on the engine and located so that the lifter perch abuts the stop and limits movement of the spring toward the camshaft. That limit stop limits the force with which the lifter is urged against the camshaft in the non-lift positions, thus reducing wear.

A method is also provided for limiting camshaft wear on such an internal combustion engine. The method includes placing a stop on the engine and locating the stop relative to the perch to limit the movement of the spring toward the camshaft.

The various features can be used alone, or in combination with each other, and a number of such combinations are described above. These control mechanisms and methods are preferably used on intake and exhaust valves, each of which is separately controlled by moving the roller guide along the defined axis ad describe above and explained in more detail herein.

BRIEF DESCRIPTION OF THE DRAWING

These and other features and advantages of the various embodiments disclosed herein will be better understood with respect to the following description and drawings, in which like numbers refer to like parts throughout, and in which.

DETAILED DESCRIPTION

Figure 1:
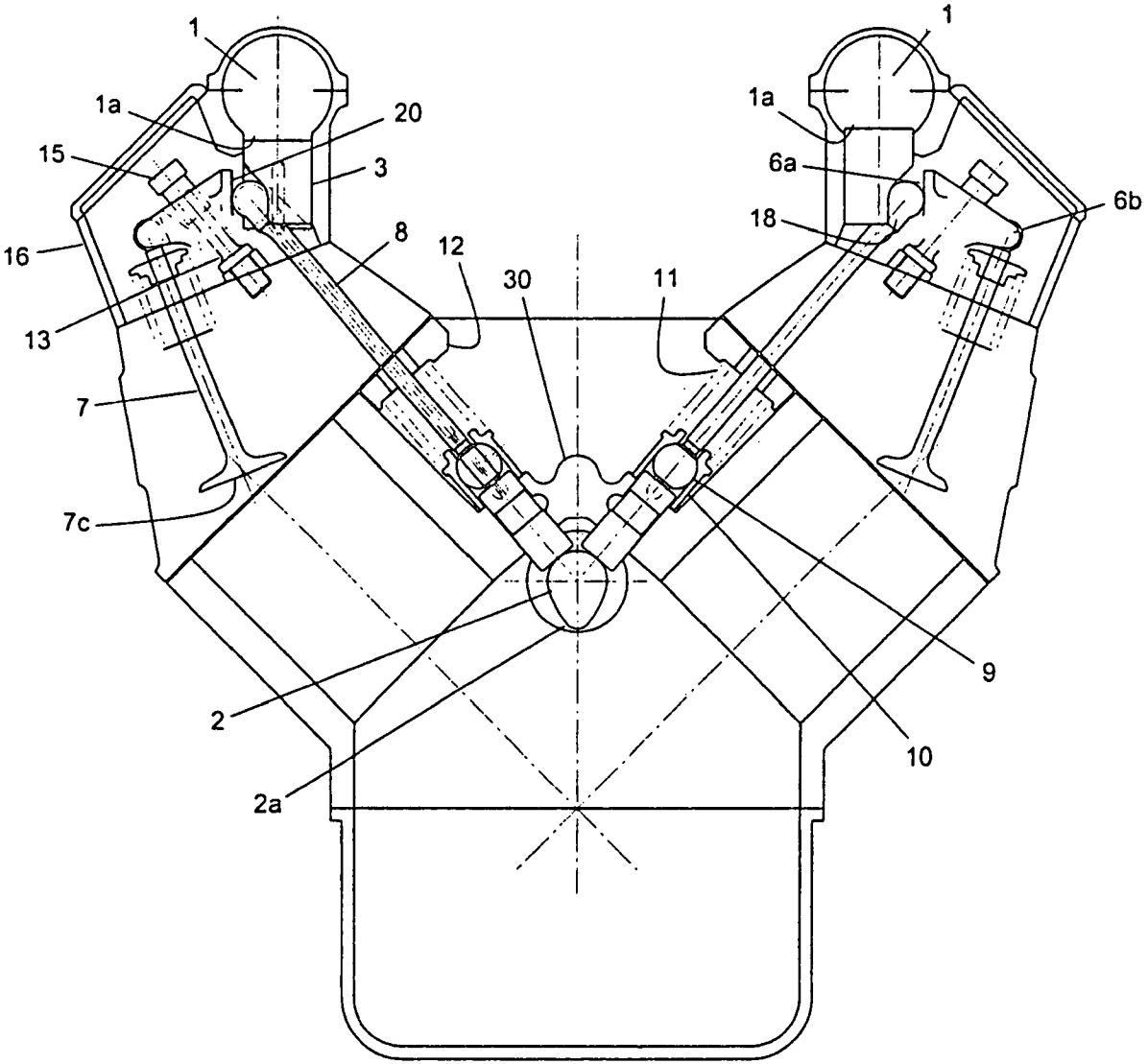
FIG. 1 shows a sectional view of a variable valve control mechanism for a typical OHV engine showing an inlet valve on the left cylinder and an exhaust valve on the right cylinder.

A brief overview is given first. Referring to FIGS. 1-10, and especially FIGS. 6-7, a camshaft 2 rotates with its cammed surface 2*a* controlling the axial motion of pushrod 8. The camshaft 2 contacts a lifter 4 connected to the pushrod 8 through spring swivel 9 and spring perch 10 which allow rotational movement about one and preferably about two orthogonal axes, with lifter spring 11 maintaining these parts in contact during operation. The end of the pushrod 8 opposite the camshaft 2 has a roller assembly 5 that includes two outer rollers 18 and one middle roller 19 (FIG. 8) that is larger in diameter than the outer rollers. Thus, the pushrod 8 has a first roller 18 abutting a profiled surface 21 and a second roller 19 abutting the rocker arm 6 so the rocker arm motion (and valve motion) derives from the shape profiled surface 21. The rollers 18, 19 all rotate about parallel axes and preferably, but optionally rotate about a common shaft and common axis. The middle roller 19 rotates in a direction opposite outer rollers 18. The middle roller 19 rolls against engaging surface 20 on rocker arm 6. The rollers 18 roll against surface 21 on roller guide 3 which is constrained to move along a predetermined axis shown as a generally vertical axis in FIG. 2, but the orientation can vary. Rotatable cammed surface 1*a* on the setting shaft 1 adjusts the position of the roller guide 3 and its profiled surface 21 relative to the rollers 18 and pushrod 8.

The setting shaft 1 is rotated so that the profiled surface 1*a* positions the roller guide 3 to a desired location. Because rollers 18 roll against surfaces 21*a*, 21*b*, 21*c* on the roller guide 3, movement of the roller guide 3 this adjusts the duration of the valve ramp, lift and closed positions as described below.

The two outer rollers 18 roll against two different, but similarly profiled surfaces on the roller guide 3 in order to control the motion of the engine valve 7. The rollers 19 roll against engaging portion 20 on a first arm 6*a* of rocker arm 6, so that the profile of the surfaces 21 thus controls motion of the rocker arm 6. The rocker arm 6 has a second arm 6*b* which abuts an end 7*a* of the valve stem 7*b* to control motion of the valve 7 and its valve head 7*c*. The rocker arm 6 is located on a rocker stud 13 and positionable along the length of that stud by nut 15.

The setting shaft 1 is rotated so that the profiled surface 1*a* positions the roller guide 3 to a desired location. Because rollers 18 roll against surfaces 21*a*, 21*b*, 21*c* on the roller guide 3, movement of the roller guide 3 this adjusts the duration of the valve ramp, lift and closed positions as described below.

Figure 2:
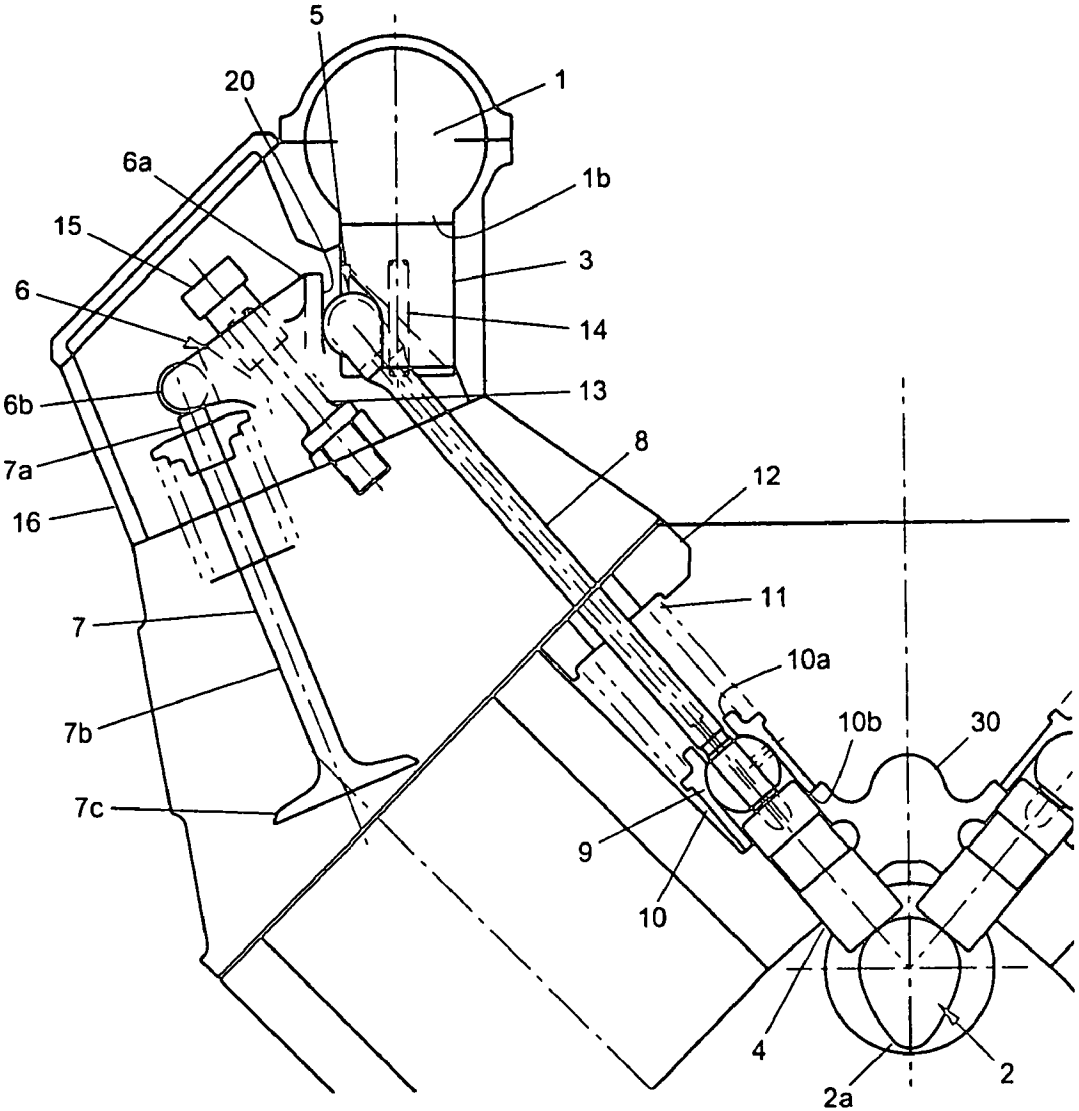
FIG. 2 shows one cylinder and the associated variable valve control mechanism of FIG. 1.
Figure 6:
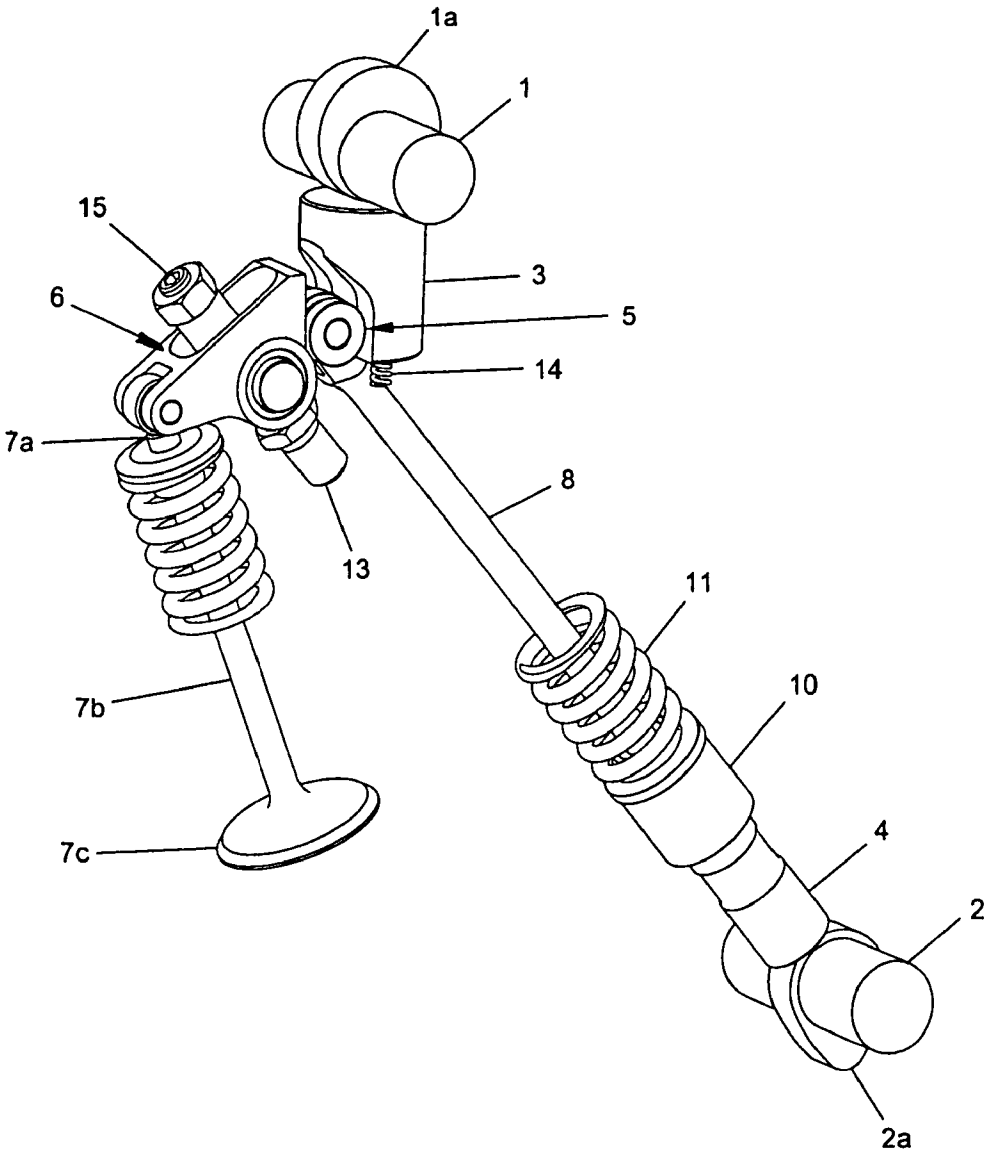
FIG. 6 shows a perspective view of the valve control mechanism of FIG. 1.
Figure 7:
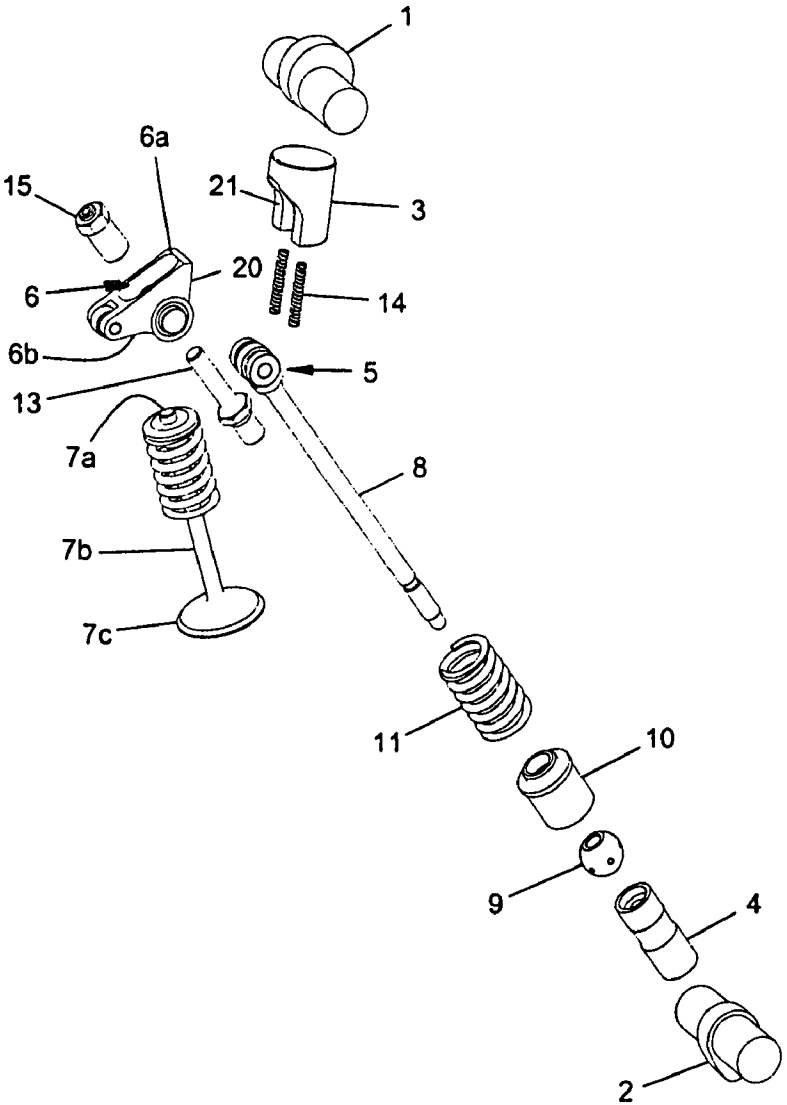
FIG. 7 shows an exploded perspective view of the valve control mechanism of FIG. 6.

In more detail, and referring to FIGS. 2 and 6-7, the setting shaft 1 preferably comprises a rotatable cylindrical shaft 1 having an eccentric lobe 1*a* with various profiles configured to position the roller guide 3. The setting shaft 1 is rotated when a change in valve operation is desired, such as altering the start, duration or end of the lift, ramp or closed positions.

The camshaft 2 is similar in design and function to a conventional camshaft. However, the profile of the cam lobes 2*a* will be optimized with regards to kinematics of the overall mechanism. Ways to optimize the design of cam lobes 2*a* are known in the art and not described in detail herein.

Roller guide 3 is constrained to move along an axis and is positioned axially by the setting shaft 1. The roller guide 3 is shown as a generally cylindrical part in a cylindrical sleeve contained in housing 16. But the configuration of the roller guide 3 can vary, as can its mounting. The roller guide 3 is preloaded against the lobe 1*a* on the setting shaft 1 by springs 14 which preferably, but optionally comprise coil springs parallel to the axis along which roller guide 3 is constrained to move. The piston-like shape of the roller guide 3 thus encircles and encloses the spring 14. Advantageously there are two springs 14, one on each side of the roller guide 3 and adjacent each of the two profiled surfaces 21. The springs 14 resiliently urge the roller guide 3 against the cammed surface 1*a* on rotary positionable setting shaft 1.

By adjusting the rotational position of setting shaft 1 and its cam or profiled surface 1*a*, the axial position of roller guide 3 relative to rollers 18 and pushrod 8 is adjusted and set. As discussed later regarding FIG. 10, the roller guide 3 has a profiled surface 21 that constrains the movement of the pushrod rollers 5 which abut this profiled surface, so the setting shaft 1 adjusts the movement of the pushrod rollers 5 by positioning the intermediate roller guide 3. The pushrod rollers 5 in turn control movement of the rocker arm 6 and valve 7.

The lifter 4 is of conventional design and function, and may optionally incorporate hydraulic adjustment as desired. The lifter 4 abuts the cam shaft 2 because it is periodically actuated by rotation of the lobed or cammed surface 2*a* on the cam shaft 2, with the motion of the lifter 4 and pushrod 8 being determined by and controlled by the shape of the cammed surface on cam shaft 2.

As best seen in FIGS. 2 and 6-8, the pushrod roller 5 is provided with three circular rollers 18, 19 centered on a common rotational axis so there are two outer rollers 18 and one central or middle roller 19. The middle roller 19 rolls against the engaging surface 20 of rocker arm 6 while the outer rollers 18 roll against a profiled or cammed surface 21 on the roller guide 3 to control movement of the rocker arm. The engaging surface 20 is preferably a flat, straight surface on the rocker arm 6*a*.

The rocker arm 6 rocks about a pivot axis and has two arms, usually on opposing sides of that axis. One arm 6*a* of rocker arm 6 has engaging surface 20 against which the pushrod roller 19 bears in order to control motion of the rocker arm. The other arm 6*b* of the rocker arm 6 bears against an end 7*a* or tip of the valve stem 7*b* in order to control motion of the valve. The rocker arm 6 transfers the motion of the pushrod roller 5 into movement of the valve 7, because the roller 5 moves one arm 6*a* of the rocker arm 6 so the other arm 6*b* of the rocker arm moves the valve stem 7*b* of valve 7.

The valve 7 is preferably a poppet valve assembly of conventional design and function having a valve stem 7*b* and valve head 7*c* configured to engage a valve seat in the engine. The valve head 7*c* moves to allow exhaust gas or air to enter the combustion chamber of an engine and/or to exit the combustion chamber. The valve stem 7*b* is connected to the head 7*c*, with the distal end or tip 7*a* of the valve stem abutting the rocker arm 6. A valve spring 11, usually a coil spring, resiliently urges the valve stem 7*b* and end 7*a* toward the rocker arm 6, so the parts remain in contact and so that movement of the rocker arm controls motion of the valve 7.

The pushrod 8 transmits the motion produced by the camshaft 2 and lifter 4 to the pushrod rollers 5 (18 and 19 in FIG. 8) affixed to the opposite end of the pushrod 8. The pushrod 8 has a hemispherical surface 8*a* on one end to mate with the lifter 4, allowing it to swivel relative to the lifter 4. Because alignment of the surfaces 21 and 20 will likely cause the pushrod 8 to rotate, the pushrod is configured to swivel. A swivel of a few degrees is believed suitable, with movement of 1-3 degrees believed suitable for most applications. But the amount of rotation will vary with the design.

Preferably, but optionally, swiveling of the pushrod is also allowed by a hemispherical shaped spring swivel 9 which allows angular movement between the pushrod 8 and spring perch 10. The spring swivel 9 has a threaded connection to pushrod 8, which allows for adjustment at assembly by rotating the swivel 9 to move it along the length of the threaded segment of the pushrod 8. The spring perch 10 has a recess configured to receive and mate with swivel 9. A lifter spring 11, preferably a coil spring, encircles the pushrod 8, with a first end of the spring 11 adjustably positioned along the length of the pushrod 8 by various means known in the art. For example, a spring plate 12 is shown with the pushrod extending through a hole in the plate 12 so the plate restrains axial movement of one end of the lifter spring 11. The function of the spring plate 11 may be incorporated into the design of the cylinder head by providing a stop serving the same purpose as the spring plate. The second end of the lifter spring 11 abuts the lifter perch 10, and transmits the lifter spring force such that the pushrod 8 and lifter 4 maintain contact with the camshaft 2 during operation. Advantageously a centering flange 10*a* extends from the lifter perch 10 on the inside of the lifter spring 11 to help position the spring and maintain alignment and contact between the spring and perch. The lifter spring 11 is thus positioned along the pushrod 8 to resiliently urge the lifter 4 against the camshaft 2.

The spring perch 10 preferably, but optionally has a stop surface 10*b* that bears against the engine block 30. This stop surface 10*b* prevents the lifter spring force from being transmitted through the camshaft/lifter interface when the lifter is working against the camshaft's base circle (i.e. the portion of the camshaft profile that does not produce any lift). This stop surface 10*b* helps minimize friction loss in the mechanism because it prevents the lifter spring 11 from resiliently urging the lifter 4 against the cam 2*a* and camshaft 2 during portions of the cam rotation which do not activate the lifter 4 and pushrod 8.

The rocker arm 6 typically includes a rocker arm stud 13 and rocker arm nut 15. The stud 13 and nut 15 attach the rocker arm to the engine, typically by attaching to the cylinder head. The rocker arm stud 13 is preferably aligned along an axis that passes through the rocker arm pivot axis, with the rocker arm 6 positioned along the stud and abutting the nut 15, yet free to rotate or rock. Rotation of the rocker arm nut 15 moves the nut along the length of the rocker arm stud 13 and that adjustably positions the rocker arm 6 along the rocker arm stud 13, thereby adjusting the location of the rocker arm pivot axis along the length of the rocker arm stud 13. Alternatively, a plurality of the rocker arms 4 may be mounted on a common shaft and some of the supporting studs 13 omitted.

The mechanism housing 16 is preferably provided to enclose the adjustable valve mechanism. The shape of housing 16 will vary according to the engine design and the design of the valve mechanism. The mechanism housing 16 is shown as being a separate component from the cylinder head. However, the mechanism housing 16 maybe incorporated into the configuration of the cylinder head if desired. The mechanism housing 16 contains the cylinder within which the roller guide 3 moves axially, and the housing 16 also provides a rotational support for the rotational setting shaft 1, but these support functions could be implemented by separate structure apart from the housing 16.

Figure 8:
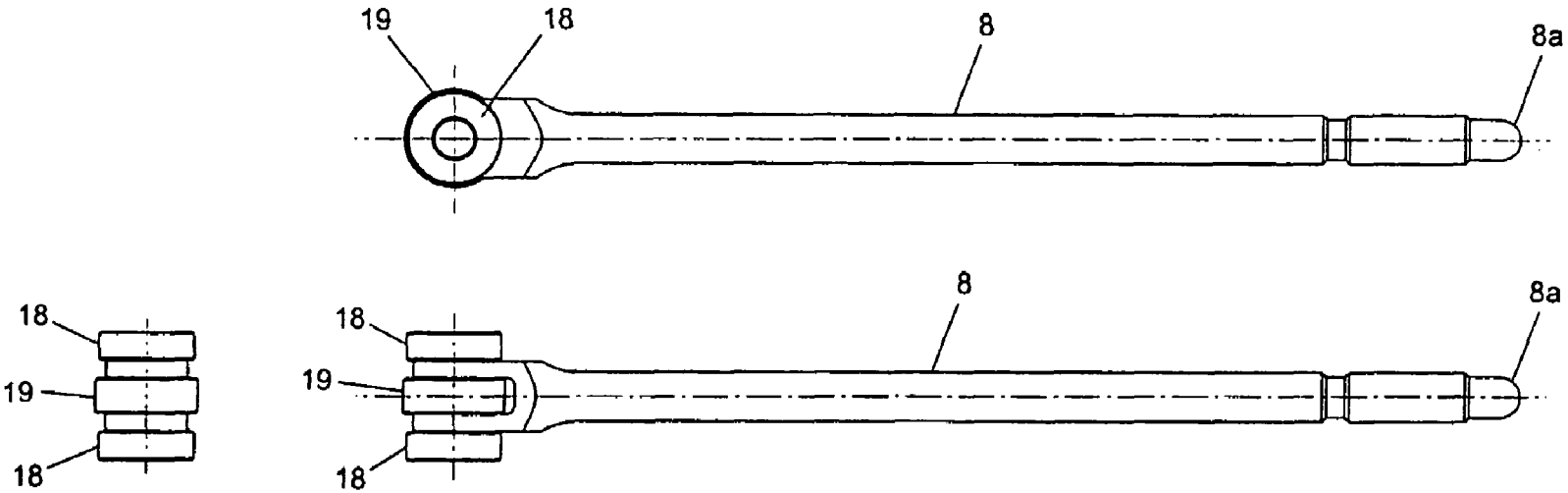
FIG. 8 shows the side, top and left side orthographic views of a pushrod and pushrod rollers used with the valve control mechanism of FIG. 1.

As shown in FIG. 8, the pushrod rollers 18 and 19 are of different diameter. The center roller 19 has a larger diameter the outer rollers 18. The center roller 19 bears against the engaging portion 20 of rocker arm 6 and the two outer rollers 18 bear against an opposing surface 21 on the roller guide 3. The engaging surface 20 of rocker arm 6 and the profiled surfaces 21 face each other in the depicted embodiment. Having differing roller diameters allows the inner and outer rollers (19, 18 respectively) to bear against these opposing surfaces and still roll in opposite directions. They preferably roll along a common axis and about a common shaft, thus minimizing friction losses and reducing the parts.

The rollers 18, 19 preferably roll along a common axis and more preferably use a common axle. Thus, the end of pushrod 8 has a two pronged yoke with axially aligned holes in each yoke, and a shaft extending through those holes so one roller 19 is mounted between the two yokes and the outer rollers 18 are cantilevered on an outer side of each yoke. If desired, the end of the pushrod 8 could have four yokes, with each of the two outer rollers 18 and the middle roller 19 mounted between two adjacent yokes for a more sturdy support.

Figure 10:
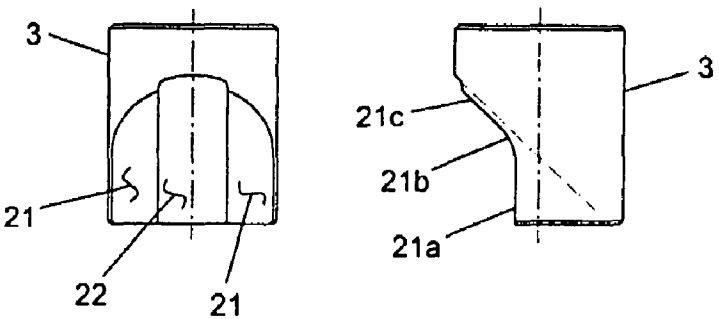
FIG. 10 shows the front and right side orthographic views of the roller guide used with the valve control mechanism of FIG. 1.
Figure 9:
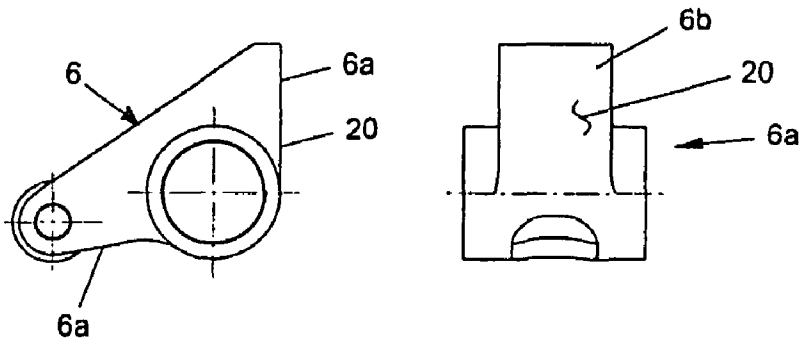
FIG. 9 shows the front and right side orthographic views of the rocker arm used with the valve control mechanism of FIG. 1.

The configuration of the roller guide 3 is shown in FIG. 10. The roller guide is generally cylindrical in shape. The center of the roller guide contains inclined surface 22, which is typically a groove between profiled or cammed surfaces 21 in order to provide clearance for center roller 19 which extends into that groove. The inclined surface 22 is shown as extending through the diameter of the guide 3, from one side to the other side in order to provide clearance for center roller 19. The shape of surface 22 can vary as long as clearance with center roller 19 is provided. The center pushrod roller 19 is located adjacent this inclined surface 22 but does not abut it. The inclined surface 22 is thus preferably recessed relative to cammed surfaces 21 in order to provide clearance for the center pushrod roller 19 as well as serving as a position limit and/or guide for the pushrod body 8.

On opposing sides of this (optionally) flat, inclined surface 22 are profiled or cammed surfaces 21 which preferably, but optionally do not extend more than half way through the diameter of the roller guide 3. But the shape of the profiled surface 21 will vary. The two cammed surfaces 21 each have the same profile, and each outer pushrod roller 18 abuts one of these cammed surfaces 21.

Because the center roller 19 is on the same axis as outer rollers 18 the centers of rollers 18, 19 have the same motion, and center roller 19 will thus track the motion of rollers 18 along the profiled surface 21. Because center roller 19 abuts engaging surface 20 of rocker arm 6*a*, the roller 19 causes the rocker arm to move according to the profiled surface 21. The rollers 18, 19 rotate in different directions, but about the same axis.

The roller guide 3 thus has profiled surfaces 21 designed to guide the outer pushrod rollers 18 along the profiled surface 21, with the center roller 19 transferring that predetermined motion to the rocker arm 6 which in turn operates the valve 7 to move with a predicted motion that is a variation of that predetermined motion of rollers 18, 19 and profiled surface 21. The motion of rocker arm 6 is thus determined by the configuration and location of profiled surface 21.

Referring to FIGS. 2 and 10, the roller guide surface 21 has three regions. First region 21*a* is a portion of the guide surface 21 that is essentially parallel to the engaging surface 20 of the rocker arm 6, and that is preferably, but optionally generally parallel to the axis along which the roller guide moves. This first region 21*a* is the region most distant from the setting shaft 1 as shown in FIG. 10. As the pushrod rollers 18 pass along this portion 21*a*, the rollers 18 (and roller 19) do not move any closer to engaging surface 20 on the rocker arm 6*a*, and thus do not result in any rocker arm movement or valve lift. Because the rollers 18 are rolling on a surface 21*a* which is parallel to the rocker arm engaging surface 20, there is no relative movement between the rollers 18 and the rocker arm engaging surface 20. By adjusting the length of this parallel portion 21*a* and the time which the rollers 18 abut this parallel portion 21*a*, the duration which the valve is closed can be adjusted. This initial portion 21*a* of the guide surface 21*a* is called the "closed" portion, because it adjusts the time the valve remains in the closed position at the beginning and end of each valve cycle.

Middle region 21*b* is a portion of the guide surface 21 that moves very gradually towards the engaging surface 20 of the rocker arm 6, and thus produces a very gradual initial/final movement of the rocker arm and valve. As the rollers 18 roll along surface 21*b* the rollers move toward the engaging surface 20 and thus the middle roller 19 moves toward rocker arm surface 20 and rotates the rocker arm 6 which in turn moves valve 7. In conventional camshaft terminology, this is referred to as the opening/closing "ramp" and this portion 21*b* is referred to as the ramp portion. The ramp is necessary to minimize and control the impact velocities between the valve and its valve seat. High impact velocities can create abnormal valve wear and noise. The profile of the middle ramp portion 21*b* will vary with the engine and valve design.

Region 21*c* is a portion of the guide surface 21 that moves more aggressively towards the engaging surface 20 of the rocker arm 6. Region 21*c* is located on the portion of guide surface 21 that is closest to the setting shaft 1 as shown in FIG. 2. The rollers 18 thus cause the rocker arm to move according to the profile of portion 21*c* and thus aggressively pivot the rocker arm 6 which moves the valve 7. This region 21*c* is the portion of the guide surface 21 that produces the majority of the rocker motion and valve lift and is called the lift portion 21*c*. The shape of this lift profile is designed to work in conjunction with the shape of the profile of camshaft 2, to produce the desired kinematic characteristics within the overall mechanism.

The motion of rollers 18 along profiled surface 21 is cyclic, going first one direction to open the valve, and retracing the path in the opposite direction to close the valve. In operation, the valve lift and duration is initially adjusted by placing setting shaft 1 and roller guide 3 in positions or orientations that produce a desired valve operation relative to the movement resulting from profile 21.

Figure 3:
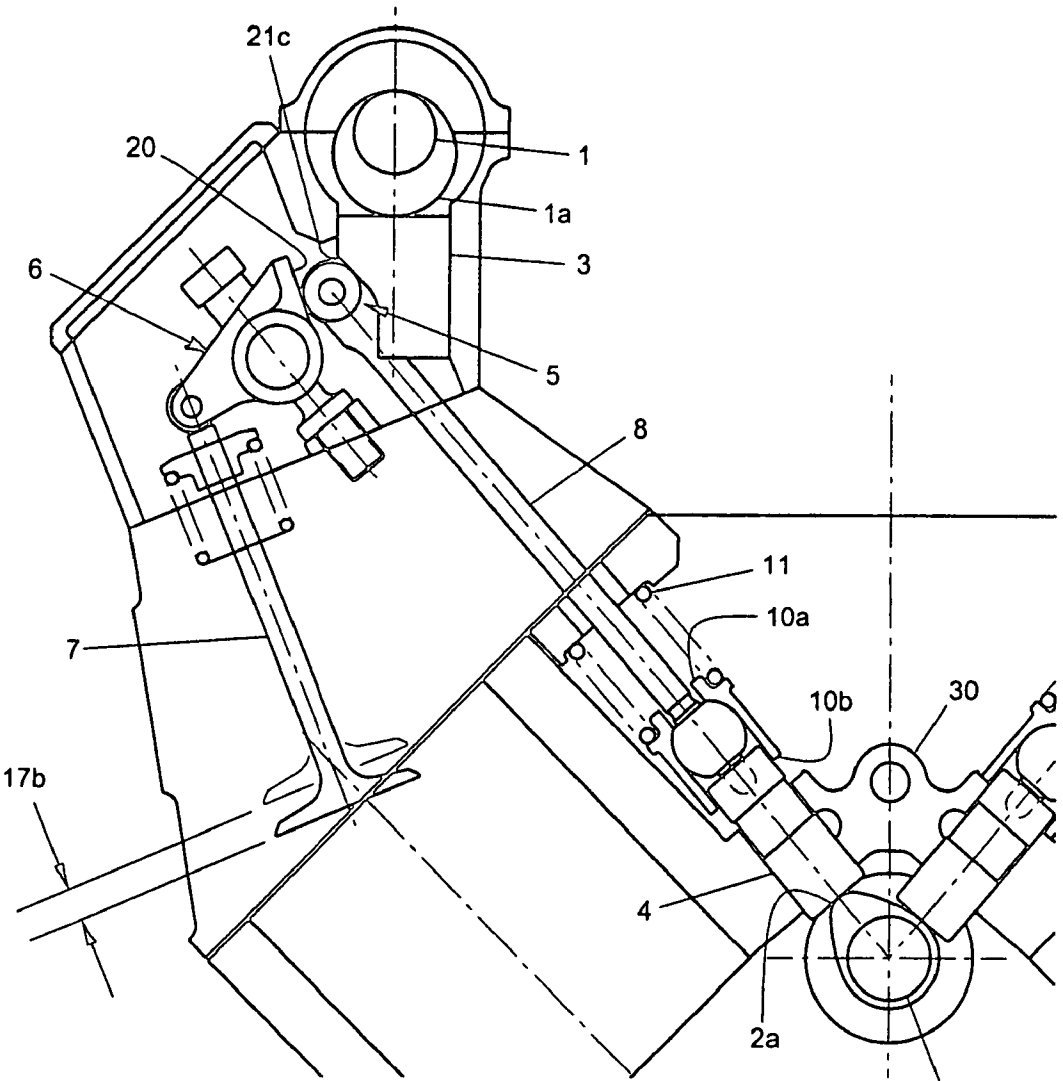
FIG. 3 shows a setting shaft and roller guide of FIG. 1, with these parts in their respective positions to produce maximum valve lift and duration.
Figure 4:
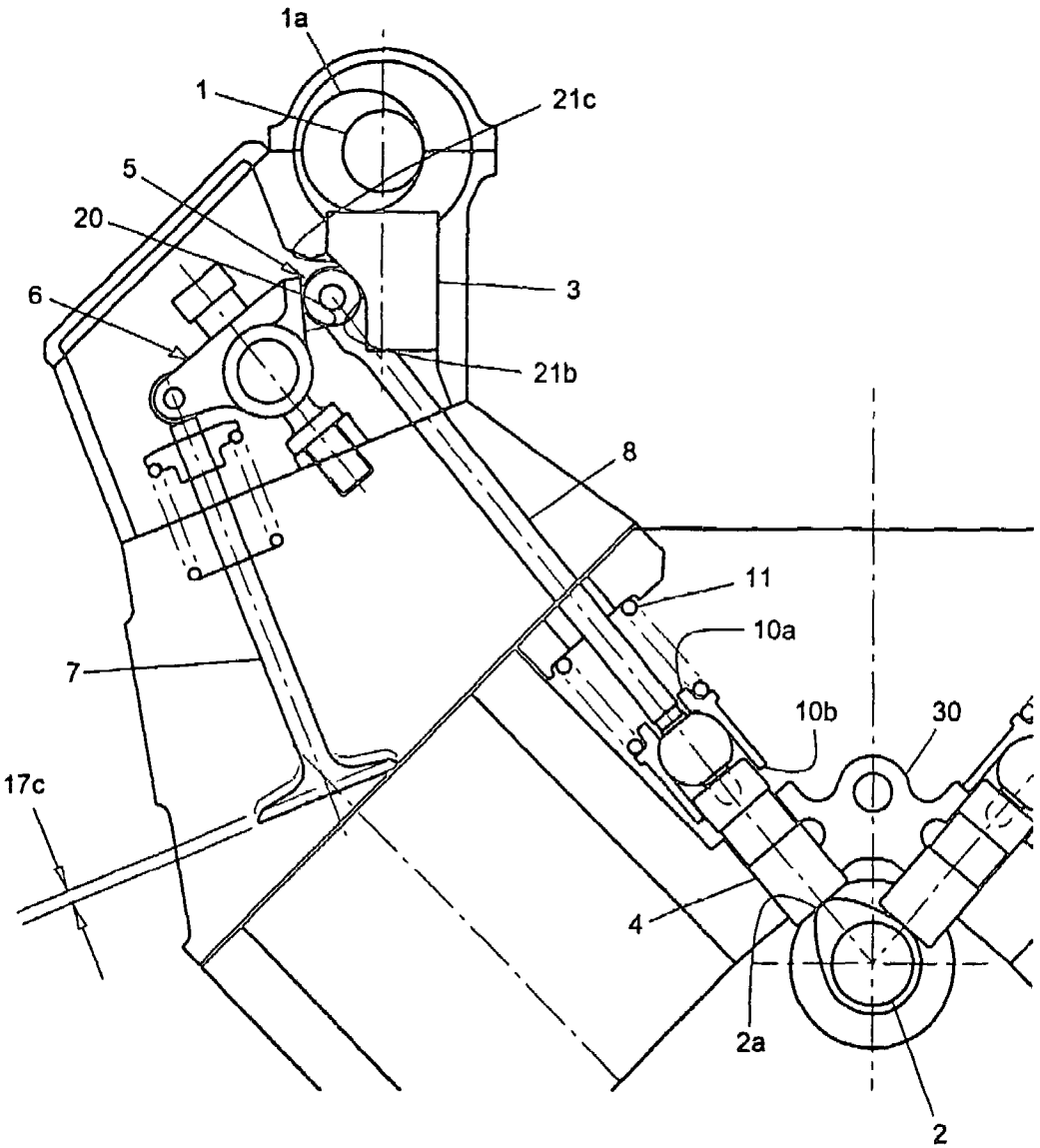
FIG. 4 shows the setting shaft and roller guide of FIG. 1, with these parts in their respective positions to produce a medium valve lift and duration.

FIG. 3 shows the setting shaft 1 and roller guide 3 in their respective positions that produce maximum valve lift and duration, as indicated by dimension 17*b*. In this position cam 2*a* is positioned to move pushrod 8 to its most distant position from camshaft 2. In this position the contact portion 10*b* on the spring perch 10 is not in contact with the engine block 30. More importantly, the profiled surface 1*a* is positioned to move roller guide 3 to a position that is more distant from shaft 1, with outer rollers 18 abutting portion 21*c* of the profiled surface 21 on the roller guide, and with FIG. 4 shows the setting shaft 1 and roller guide 3 in their respective positions that produce a medium valve lift and duration, as indicated by dimension 17*c*. The profiled surface 1*a* is positioned to move roller guide 3 to a position closer to shaft 1 but intermediate the extreme positions, so that outer rollers 18 abut portion 21*c* of the profiled surface 21 on the roller guide do not extend along surface 21*c* as much as in the maximum lift position, and thus the rocker arm 6 is not rotated as much.

Figure 5:
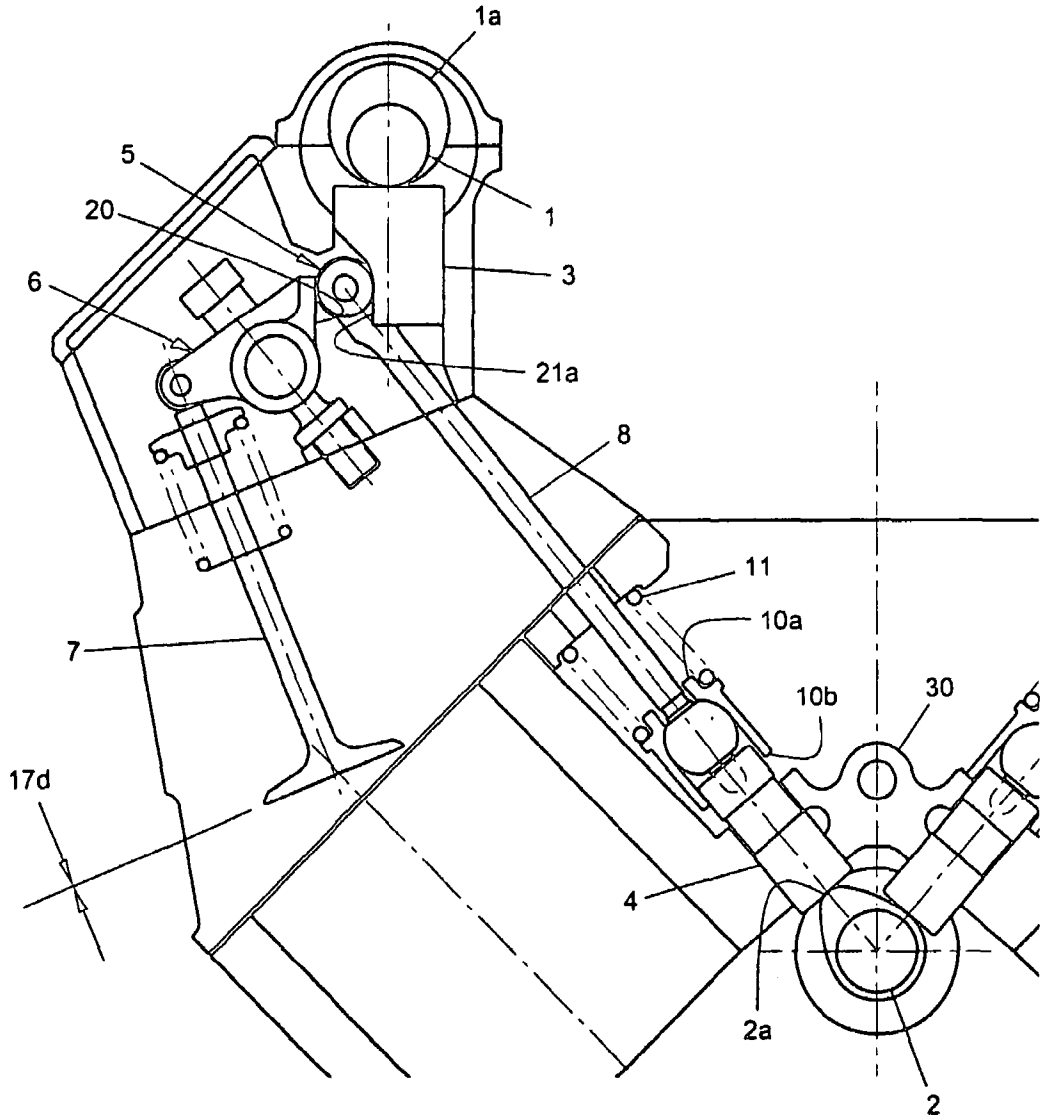
FIG. 5 shows the setting shaft and roller guide of FIG. 1, with these parts in their respective positions to produce minimum valve lift and duration.

FIG. 5 shows the setting shaft 1 and roller 3 in their respective positions that produce minimum valve lift and duration, as indicated by dimension 17*d*. In the example shown, the minimum valve lift and duration values are both zero. The profiled surface 1*a* is positioned to move roller guide 3 to its position closest to shaft 1, with outer rollers 18 abutting portion 21*a* of the profiled surface 21 on the roller guide. The position of cam 2*a* and pushrod 8 are as before.

The valve lift and duration is infinitely variable between the maximum (FIG. 3) and minimum (FIG. 5) settings of the valve adjustment mechanism. The profile surface 21 varies the rate of valve movement as the valve passes through the valve closed, ramp and lift cycles, while the position of the profile surface 21 relative to the rollers 18 (via setting shaft 1 and cam 1*a*) varies the maximum valve lift and cycle duration as discussed later regarding FIGS. 12-13. The shape of the ramp portion 21*b* can be varied to achieve different ramp rates and forces. Positioning the rollers 18 along the profiled surface 21 (by setting cam shaft 1*a*), allows selecting various portions of the profile 21 and its associated motions of the rocker arm 6 and valve 7.

The position of setting shaft 1 can be releasably fastened in position by various means, such as screws, clamps or other devices for a long term fixed setting. But preferably the movement of shaft 1 is dynamically or actively controlled by cables, belts, gears, linkages, chain drives, stepper motors, hydraulic motors and/or controls, or other control mechanisms. The movement can also be variably controlled using input from sensors detecting various engine parameters such as speed, fuel, oxygen, engine temperature or combustion constituents, or detecting various environmental parameters such as humidity and temperature. Thus, for example, the valve operation can be adjusted for engine start-up, for cold weather, for hot weather, for fuel efficiency, for desired power output, for speed, etc. Other mechanisms could be used to position the roller guide, including a threaded projection abutting or connected to a portion of the roller guide 3 to position the guide along its axis.

Referring to FIG. 1, the cammed surface 1*a* on setting shaft 1 on the left side is larger than the cammed surface 1*a* on the right side. The left side is shown as the intake and the right illustrates the exhaust, and typically the valve lift on the intake is larger than on the exhaust, thus, the cammed surface 1*a* is larger on the intake than on the exhaust. As indicated by FIG. 1, the valve adjust mechanism can vary between the intake and exhaust valves 7.

Further, while a simpler construction is provided by having setting shaft 1*a* common for all intake valves and a different setting shaft 1*a* for all exhaust valves, it is preferable for each valve to be separately controlled, or for sub-groups of valves to be separately controlled. If each valve 7 is separately controlled, then each valve can be separately adjusted to optimize various engine parameters, such as power, fuel efficiency, or emission control. Further, by moving the setting shaft 1 to provide a minimum valve open position, fewer than all cylinders could be selectively operated. Thus, for example, six of eight cylinders in an engine could be provided with fuel and air while two cylinders have the intake valves remaining shut or slightly open to prevent vacuum conditions, with a slight exhaust opening to ensure the shut-off cylinders are cleared of any gases and to guard against vacuum conditions. Thus, it is preferable that one valve adjustment mechanism be provided for the intake valve or valves 7 on a particular cylinder, and that a separate mechanism be provided for the exhaust valve (s) on that particular cylinder, with each adjustment mechanism being separately controlled to achieve a desired control of one or more engine parameters, including such engine parameters as fuel consumption, power, or emissions.

Figure 11:
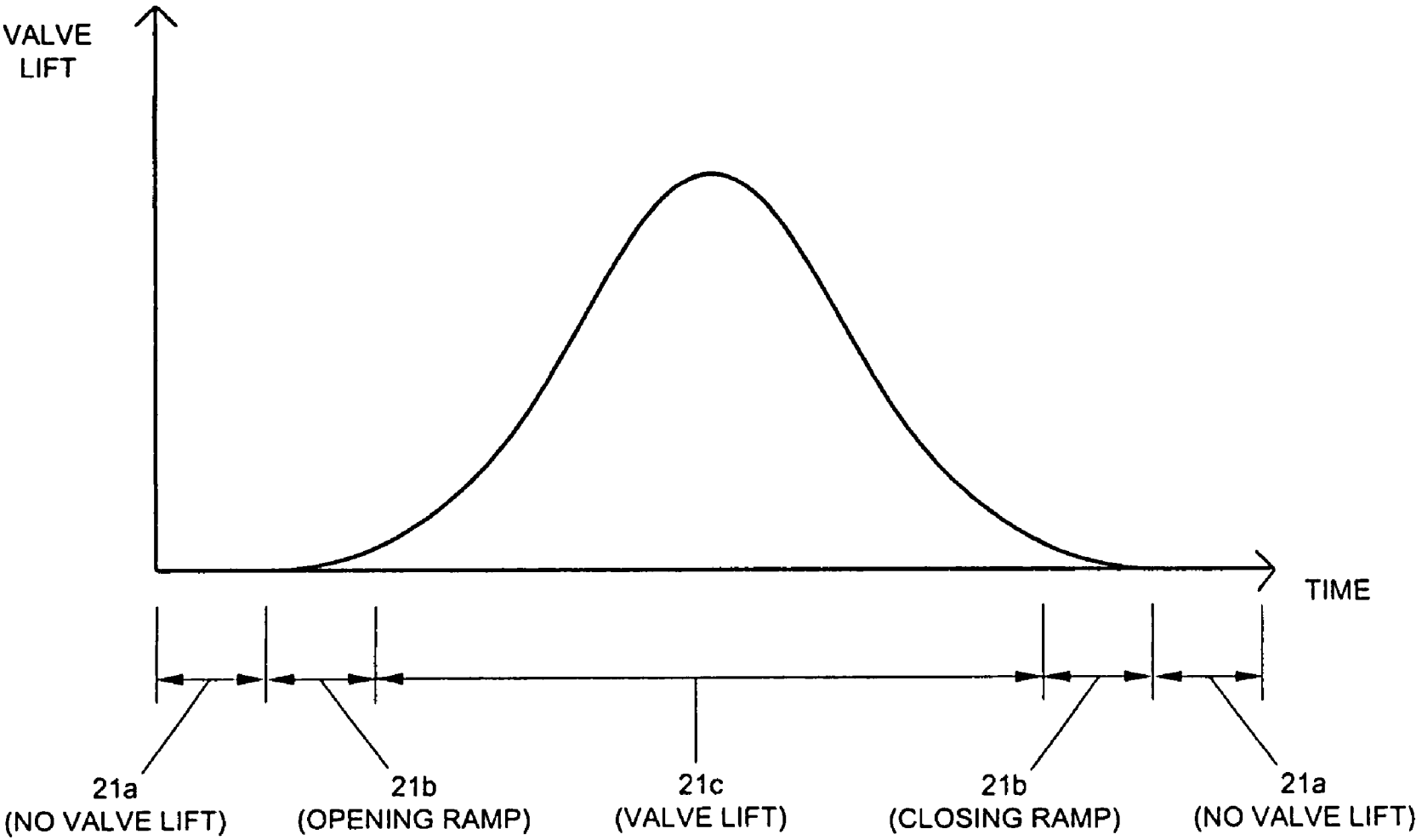
FIG. 11 shows a graph of valve lift as a function of time.

Referring to FIG. 11, an illustrative graph of the valve operation resulting from a profiled surface 21 is shown. The valve lift is shown on the vertical axis and time is on the horizontal axis. Because the rollers 18 travel the profiled surface 21 for each cycle of the pushrod 8, the curve is symmetric. By altering the profile 21 and the length and shape of the profile portions 21*a*, 21*b*, 21*c*, the shape of the curve shown in FIG. 11 can be altered and the duration of the various lift, ramp and closed portions can be changed.

Figure 12:
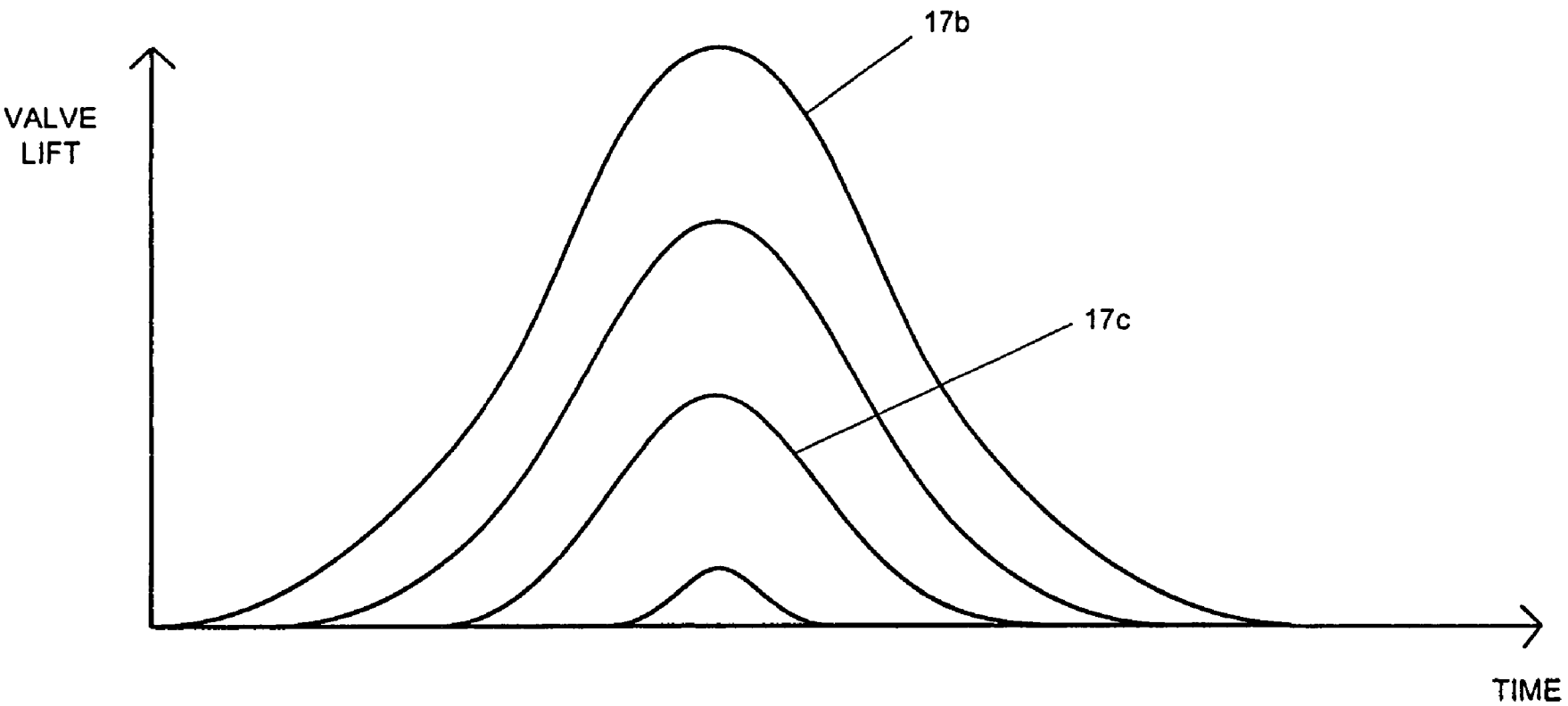
FIG. 12 shows a series of graphs of valve lift as a function of time for a single valve.

Using the same profile 21 but altering the beginning and ending portions by positioning roller guide 3 using cam 1*a*, the general shape of the motion curve remains the same but it is shifted on the vertical, motion axis. This is shown in FIG. 12, which shows the valve motion sequence for maximum valve lift 17*b* as described in FIG. 3, and also shows the valve motion for a medium lift 17*c* as described in FIG. 4. The same profiled surface 21 is used for both valve motions so the curves are symmetric, but vertically shifted on the graph.

Figure 13:
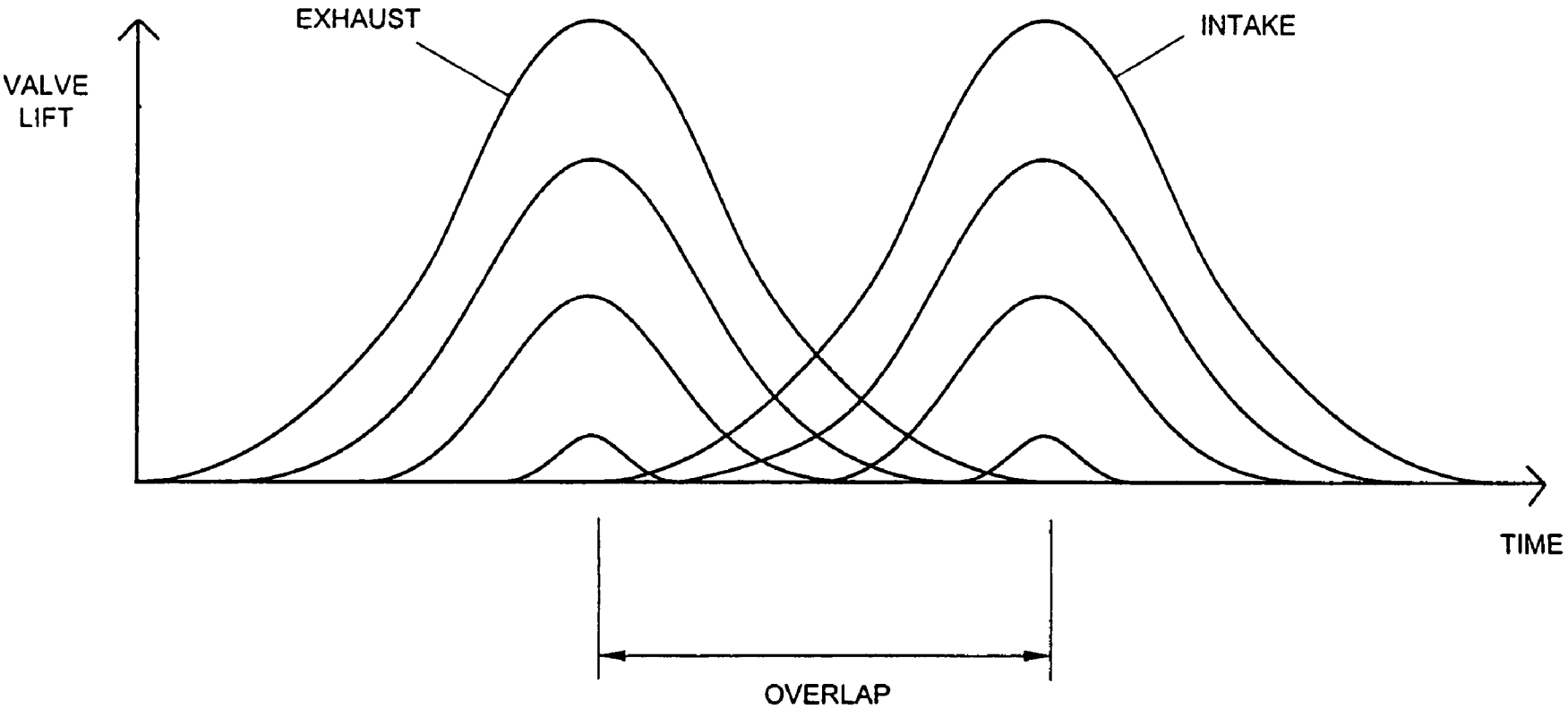
FIG. 13 shows a series of graphs of valve lift as a function of time for two valves, to illustrate the valve overlap.

Referring to FIG. 13, the longer the valves remain open or closed, the longer the overlap in operation of the valves on the intake and exhaust. The valve overlap can affect emissions in complex ways since less overlap allows a longer power stroke, more complete combustion and less hydrocarbons but may increase nitrogen oxides, while more overlap allows a shorter power stroke, but less complete combustion and possibly fewer nitrogen oxides. By varying the valve timing, the power of the engine can be varied, as can emissions. The valve adjustment can thus be used to vary engine power and performance in conjunction with the fuel provided to the engine.

The variable valve control mechanism described herein can be adapted to any OHV engine configuration. The mechanism may be applied to just the intake valves, just the exhaust valves, or it may be applied to both intake and exhaust valves. The mechanism can be used to vary valve lift, duration of valve opening, and overlap of intake and exhaust valve open periods. The mechanism provides infinite adjustment of valve lift and valve open duration, within the range of its design parameters.

Further variation is provided by using separate camshafts for the intake and exhaust to allow more variation in the valve overlap characteristics. There are several known methods for varying camshaft phasing that may be employed, one of which is described in U.S. Pat. No. 6,883,480, the complete contents of which are incorporated herein by reference.

The above description is given by way of example, and not limitation. Given the above disclosure, one skilled in the art could devise variations that are within the scope and spirit of the invention disclosed herein, including various ways of arranging the profiled surfaces described herein to achieve various sequences of valve operation. Further, while three rollers 18, 19 are used, it is believed possible to use only two rollers, or to use more than three rollers. While the rollers 18, 19 are preferably on the same or parallel axes it is believed possible to offset the rotational axes of the roller(s) 18 and 19 and/or to incline the rotation axes relative to each other. While the rollers 18, 19 are of different diameter, by correct positioning approximately the same sized rollers could be used, or by putting the engaging surface 20 on a protruding rib the middle roller 19 could be smaller diameter than the outer rollers. Moreover, the engaging surface 20 on rocker arm could be inclined and straight, or it could be curved or otherwise profiled to further adjust the movement of the valve 7. Additionally, the outer rollers 18 could rotate about profiled surfaces 21 that are inclined relative to each other rather than being parallel as illustrated, in order to further center the roller guide 3. But the complexity of maintaining contact with such inclined surfaces is undesirable. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. A valve control mechanism for an overhead valve, internal combustion engine having a camshaft moving a pushrod to move a rocker arm that in turn moves the valve, the pushrod defining a first end portion opposite the camshaft and a second end portion adjacent to the camshaft, comprising:

a first roller rotatably connected to the first end portion of the pushrod that is opposite the camshaft;

a second roller rotatably connected to the first end portion of the pushrod that is opposite the camshaft;

a roller guide having a first profiled surface, the first roller and roller guide positioned so the first roller rolls along the first profiled surface, the first profiled surface configured to achieve a desired valve movement; and an engaging surface on the rocker arm with the rocker arm and second roller positioned so the second roller rolls along the engaging surface of the rocker arm to rotate the rocker arm as the first roller rolls along the first profiled surface.

2. The valve control mechanism of claim 1, wherein the engaging surface is straight and the roller guide is adjustably positionable along a first axis parallel to the straight engaging surface.

3. The valve control mechanism of claim 1, further comprising a third roller rotatably connected to the first end portion of the pushrod opposite the camshaft, with the first and third rollers being on opposing sides of the second roller, and wherein the roller guide has a second profiled surface spaced apart from the first profiled surface but configured the same as the first profiled surface and located to engage the third roller.

4. The valve control mechanism of claim 1, further comprising a third roller rollably connected to the end of the pushrod opposite the camshaft, with the first and third rollers being on opposing sides of the second roller, with the first and third rollers being of smaller diameter than the second roller.

5. The valve control mechanism of claim 4, wherein the engaging surface on the rocker arm is straight and parallel to a straight portion of the first profiled surface.

6. The valve control mechanism of claim 4, wherein the first, second and third rollers rotate about a common rotational axis, with the first and third rollers rolling in an opposite direction to the second roller.

7. The valve control mechanism of claim 1, wherein the engaging surface is straight and parallel to a portion of the first profiled surface of the roller guide.

8. The valve control mechanism of claim 1, wherein the engaging surface has a profile configured to further vary the motion of the valve in a way that differs from having a straight engaging surface.

9. The valve control mechanism of claim 1, wherein the roller guide is positionable along a first axis by a rotating cam which moves the roller guide along that first axis, with a spring resiliently urging the roller guide against that rotating cam.

10. The valve control mechanism of claim 1, wherein the engaging surface is straight and the first profiled surface has a first straight portion parallel to the straight engaging surface to alter the valve closed duration, a second middle portion configured to alter valve ramp, and a third portion configured to alter valve lift, as the first roller moves along these three portions of the first profiled surface.

11. A valve control mechanism for an overhead valve, internal combustion engine having a camshaft moving a pushrod to move a rocker arm that in turn moves the valve, the pushrod defining a first end portion opposite the camshaft and a second end portion adjacent to the camshaft, comprising:

a roller guide having a two similarly profiled surfaces configured to control the valve closed, ramp and valve lift, the profiled surfaces spaced apart with a slot between them;

three rollers rotatably connected to the first end portion of the pushrod that is opposite the camshaft, two of the rollers coaxially aligned and abutting a different one of the profiled surfaces and the third roller fining in the slot;

a rocker arm surface on one arm of the rocker arm, the rocker arm surface located opposite the profiled surfaces with the third roller rolling on the rocker arm surface in a direction opposite the other two rollers.

12. The valve control mechanism of claim 11, wherein the roller guide is adjustably traversable along a first axis generally parallel to a portion of the profiled surface.

13. The valve control mechanism of claim 11, wherein a cammed surface abuts the roller guide to move the roller guide along a first axis that alters at least one of the magnitude or duration of the valve lift.

14. The valve control mechanism of claim 11, wherein the three rollers rotate about or parallel to a common axis, and the third roller is larger in diameter than the other two rollers.

15. A valve control mechanism for an overhead valve, internal combustion engine having a camshaft moving a pushrod to move a rocker arm that in turn moves the valve, comprising:

a pushrod having first and second rollers rotatably mounted at one end of the pushrod, the first roller rolling against a profiled surface in a first direction and the second roller rolling against an engaging surface on the rocker arm in an opposing direction and moving the rocker arm in a motion defined by the shape of the profiled surface.

16. The valve control mechanism of claim 15, wherein the profiled surface is on a roller guide movable along a first axis located to shift the profiled surface and vary the magnitude of the valve lift.

17. The valve control mechanism of claim 16, wherein the roller guide is resiliently urged against a setting camshaft, the rotation of which moves the roller guide along the first axis.

18. The valve control mechanism of claim 15, wherein the engaging surface is a straight surface, and generally parallel to a portion of the profiled surface when the valve is closed.

19. The valve control mechanism of claim 15, further comprising a swivel mount on the pushrod configured to permit the one end of the pushrod to rotate a few degrees.

20. The valve control mechanism of claim 15, further comprising a lifter spring resiliently urging a lifter against the camshaft, the spring engaging a lifter perch which abuts a stop on the engine located to limit motion of the perch and spring toward the camshaft.

* * * * *